US008418520B2

(12) United States Patent
Stucki et al.

(10) Patent No.: US 8,418,520 B2
(45) Date of Patent: Apr. 16, 2013

(54) PRESS JAW PAIR FOR PRESSING UNITS

(75) Inventors: Andreas Stucki, Gelterkinden (CH); Beat Schweizer, Titterten (CH)

(73) Assignee: Von Arx AG, Sissach (CH)

( * ) Notice: Subject to any disclaimer, the term of this patent is extended or adjusted under 35 U.S.C. 154(b) by 24 days.

(21) Appl. No.: 13/224,707

(22) Filed: Sep. 2, 2011

(65) Prior Publication Data

US 2012/0055225 A1 Mar. 8, 2012

(30) Foreign Application Priority Data

Sep. 3, 2010 (CH) ..... 1426/10

(51) Int. Cl.
*B21D 41/04* (2006.01)

(52) U.S. Cl.
USPC ..... 72/416; 72/409.01; 72/453.16; 29/237

(58) Field of Classification Search ..... 72/407, 72/409.01, 409.1, 416, 453.15, 453.16; 29/237, 29/751
See application file for complete search history.

(56) References Cited

U.S. PATENT DOCUMENTS 6,434,998 B2 * 8/2002 Amherd ..... 72/416
7,216,523 B2 5/2007 Frenken
7,409,846 B2 8/2008 Frenken
7,665,343 B2 * 2/2010 Ballas et al. ..... 72/416
2006/0000072 A1 1/2006 Frenken
2007/0020988 A1 1/2007 Frenken
2007/0214918 A1 9/2007 Frenken
2008/0072436 A1 3/2008 Frenken

FOREIGN PATENT DOCUMENTS

DE 10318508 A1 8/2004
DE 102005028083 A1 2/2006
DE 202006009273 U1 10/2007
DE 102007041644 A1 4/2008

* cited by examiner

*Primary Examiner* — David B Jones

(74) *Attorney, Agent, or Firm* — Marty Fleit; Paul D. Bianco; Fleit Gibbons Gutman Bongini Bianco PL

(57) ABSTRACT

A press jaw pair for producing a press fit of fittings on pipes and the like has a first and a second one-piece press jaw lever (1, 2) that are arranged such that they are rotatable about a common axis (x). At least one bearing lug (4, 8) with a bearing opening (5, 9) is integrally formed on each press jaw lever (1, 2), wherein the bearing lugs (4, 8) are arranged coaxially in the fitting state. A torsion spring element (3) with two stop cams (10, 11) can be inserted into the bearing openings (5, 9) in such a way that the two press jaw levers (1, 2) are supported about the common axis (x) in a spring-loaded fashion and held in a mutually captive fashion.

6 Claims, 4 Drawing Sheets

PRESS JAW PAIR FOR PRESSING UNITS

FIELD OF THE INVENTION

The invention pertains to a press jaw pair for pressing units, for example, for producing a press fit of fittings on pipes and the like.

The invention specifically pertains to such a press jaw pair with two one-piece press jaw levers that are arranged such that they are rotatable about a common axis (x), wherein at least one bearing lug with a bearing opening is integrally formed on each press jaw lever, and wherein the bearing lugs are arranged coaxially in the fitting state.

BACKGROUND OF THE INVENTION

A press jaw pair of this type for hydraulic or electric pressing units is known, for example, from DE-10 2005 028 083. In this solution, each press jaw lever features two integral bearing lugs with coaxial bearing openings, wherein the bearing lugs engage into one another in the fitting state. In the fitting state, a sleeve extends through the coaxial bearing openings of the press jaw levers. The sleeve is secured with Seeger circlip rings on both sides in order to prevent the press jaw levers from axially shifting relative to one another. A tension spring is arranged between the press jaw levers on the force application side in order to hold the press jaw opening open when the pressing unit is not actuated. In this respect, such a press jaw pair forms a subassembly that can be assembled separately. Consequently, a subassembly in the form of a thusly assembled press jaw pair can then be fixed between the fork limbs of a receiving collar of the pressing unit by means of a bolt inserted through the sleeve.

One disadvantage of the above-described solution according to DE-10 2005 028 083 is that a total of at least 6 individual parts including the tension spring are required for a completely assembled press jaw pair. Another disadvantage can be seen in that asymmetric distributions of forces occur during use due to the uniformity of the press jaw levers (that, however, allows a more rational manufacture) and the interengagement of the bearing lugs. This means that the pressing forces that act against a common center are slightly shifted laterally, wherein this leads to disturbing and uncompensated torques and therefore undesirable shearing forces.

SUMMARY OF THE INVENTION

It is the primary objective of the invention to disclose an improved solution that requires fewer components and therefore also allows a simpler and faster assembly of the press jaw pair. The invention furthermore aims to disclose a solution, in which undesirable shearing forces are also prevented.

According to the inventive solution, a torsion spring element with two stop cams can be inserted into the bearing lugs in such a way that the two press jaw levers are supported about the common axis (x) in a spring-loaded fashion and held in a mutually captive fashion.

It should be possible for the press jaw opening of the pressing unit to close automatically when the pressing unit is not in use. For this purpose, stop cams of the torsion spring element are accordingly arranged in assembly recesses in the bearing lugs and the restoring forces of the torsion spring element cause the press jaw opening to automatically close in the desired fashion. All in all, the torsion spring element not only ensures the spring-loaded support, but also captively holds the press jaw levers together.

The main advantage naturally can be seen in that fewer components are required, namely only a total of 3 including the spring element. It goes without saying that this also simplifies the assembly, wherein a slight overall weight reduction is furthermore achieved.

In one preferred embodiment, a first bearing lug with a first bearing opening is integrally formed on a first press jaw lever while a pair of bearing lugs with a pair of bearing openings is integrally formed on a second press jaw lever, namely such that the first bearing lug engages into the pair of bearing lugs. Due to this measure, no asymmetric distributions of forces and therefore also no shearing forces any longer occur during use. The occurring forces are compensated by the axially symmetric design.

In a preferred embodiment, the torsion spring element is furthermore realized in such a way that it extends through the first bearing lug of the first press jaw lever and only one of the two bearing lugs of the pair of bearing lugs. In such a design, neither the spring-loaded support of the press jaw levers nor the cohesion of the press jaw levers is impaired. All in all, this even results in a slight additional weight reduction.

BRIEF DESCRIPTION OF THE DRAWINGS

One preferred embodiment of the invention is described in greater detail below with reference to the drawings. In these drawings.

DETAILED DESCRIPTION OF THE INVENTION

Figure 1A:
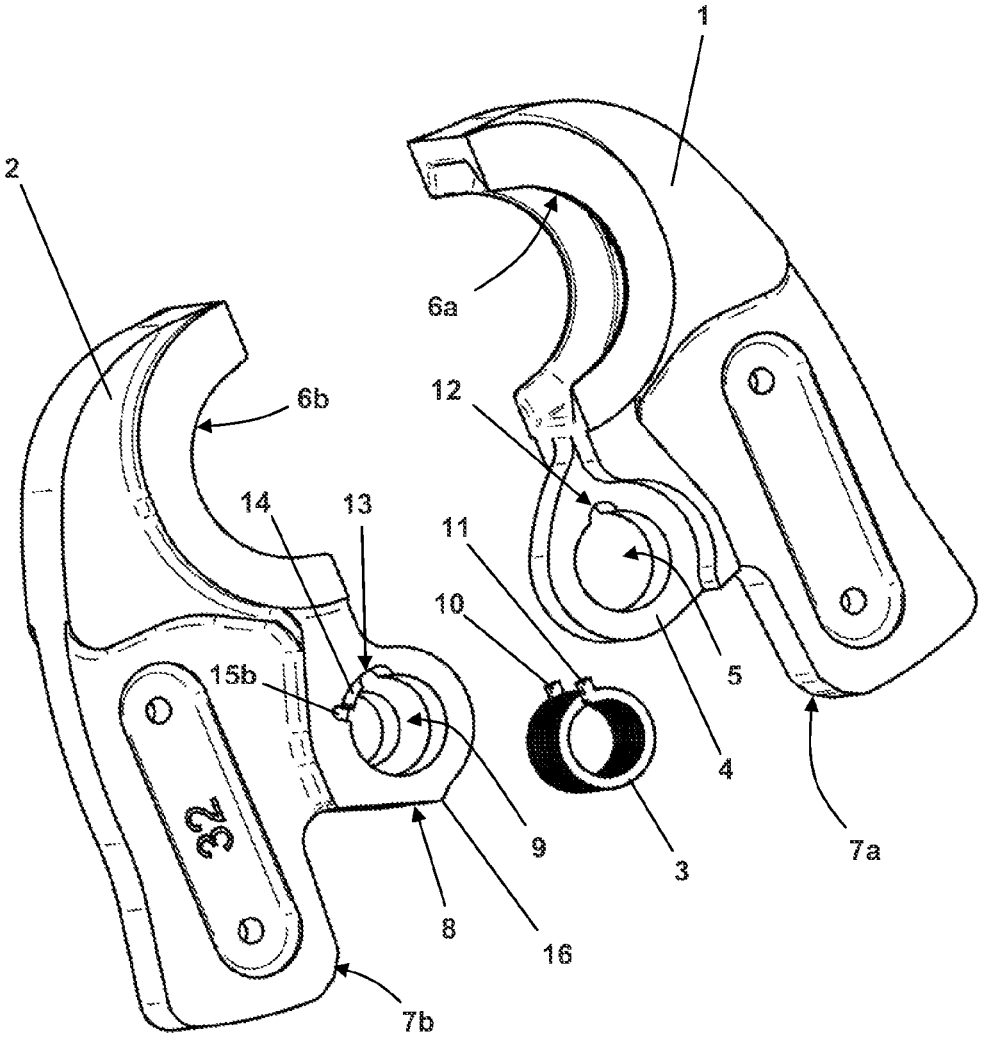
FIG. 1*a* shows the components of an inventive press jaw pair in the form of a three-dimensional front view.
Figure 1B:
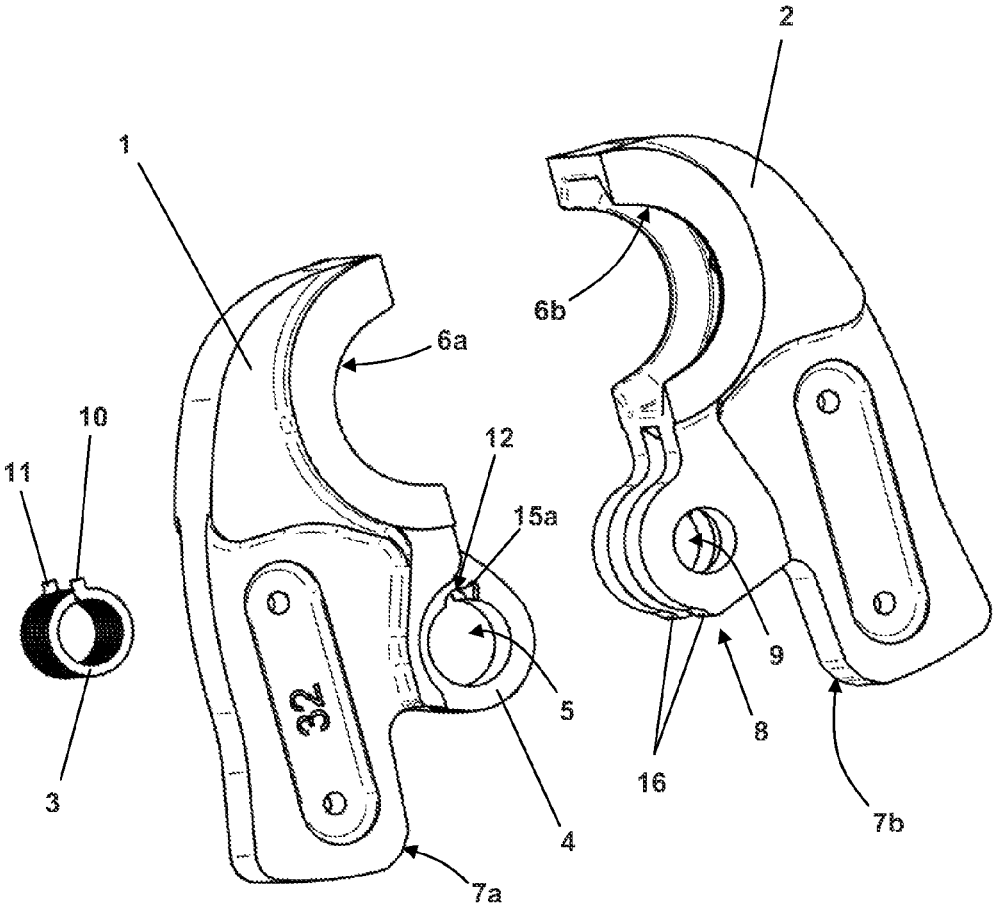
FIG. 1*b* shows the press jaw pair according to FIG. 1 in the form of a three-dimensional rear view, FIGS. 2*a, b* show a side view and a top view of the assembled and closed press jaw pair according to FIG. 1, and FIGS. 3*a, b* show a side view and a top view of the assembled and opened press jaw pair according to FIG. 1.

FIGS. 1*a* and 1*b* show the components of an inventive press jaw pair in the form of three-dimensional front and rear views. The press jaw pair essentially consists of a first press jaw lever 1, a second press jaw lever 2 and a torsion spring element 3.

The first press jaw lever 1 is realized in one piece and has a first bearing lug 4 with a first bearing opening 5 in the shape of a circular cylinder, as well as a press jaw shape 6*a* on a working end of the press jaw lever and a cam track shape 7*a* on a force application end of the press jaw lever.

The second press jaw lever 2 is also realized one piece and has a shape that is similar, but not identical to that of the first press jaw lever 1, wherein this second press jaw lever features a pair of bearing lugs 8 with a pair of bearing openings 9 in the shape of a circular cylinder. However, a press jaw shape 6*b* on a working end of the press jaw lever and a cam track shape 7*b* on a force application end of the press jaw lever are realized identical to the first press jaw lever 1. The second press jaw lever 2 furthermore features a pair of opening stops 16 that limit the jaw opening and protect the torsion spring element 3 against an excessive torque.

The torsion spring element 3 has an outside diameter that fits into the bearing opening 5 in the shape of a circular cylinder of the first press jaw lever 1 and into the pair of bearing openings 9 in the shape of a circular cylinder of the second press jaw lever 2. The torsion spring element 3 furthermore features a first stop cam 10 and a second stop cam 11. The torsion spring element 3 serves for ensuring that the two press jaw levers 1, 2 are supported in a spring-loaded fashion and captively held together after it is inserted into the bearing opening 5 and the pair of bearing openings 9. In the assembled state, the press jaw levers 1, 2 therefore are arranged such that they are rotatable about a common axis (x) (in this context, see also FIGS. 2 and 3).

The first bearing opening 5 of the first bearing lug 4 of the first press jaw lever 1 features a first assembly recess 12, into which the first stop cam 10 of the torsion spring element 3 protrudes in the assembled state. The first assembly recess 12 also has a latching position 15*a* (in this context, see FIG. 1*b*).

One bearing opening of the pair of bearing openings 9 of the second press jaw lever 2 features a second assembly recess 13, into which the second stop cam 11 of the torsion spring element 3 protrudes in the assembled state. The second assembly recess 13 also has an inserting region 14 and a latching position 15*b*. The assembly recesses 12, 13 with the inserting region 14 and the latching positions 15*a*, 15*b* serve for realizing and for simplifying the insertion of the torsion spring element 3 and the assembly of the press jaw pair. Other details regarding the assembly are provided further below.

Torsion spring elements of the type shown have the property of generating a resilient restoring force when they are subjected to torsional stress. In this case, the restoring force is used in such a way that the press jaw levers 1, 2 close automatically when they are not in use.

Figure 2A:
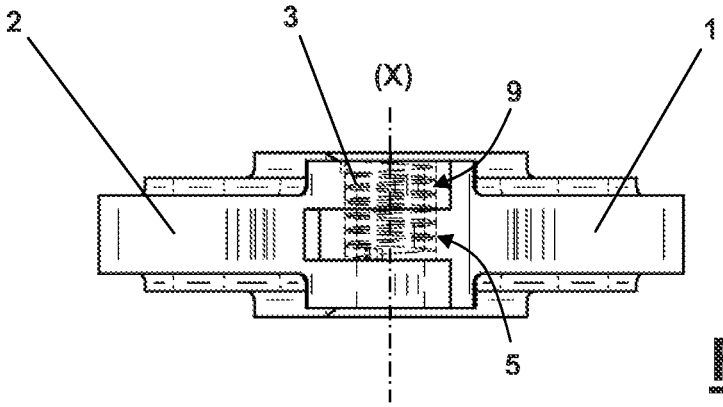
Figure 2B:
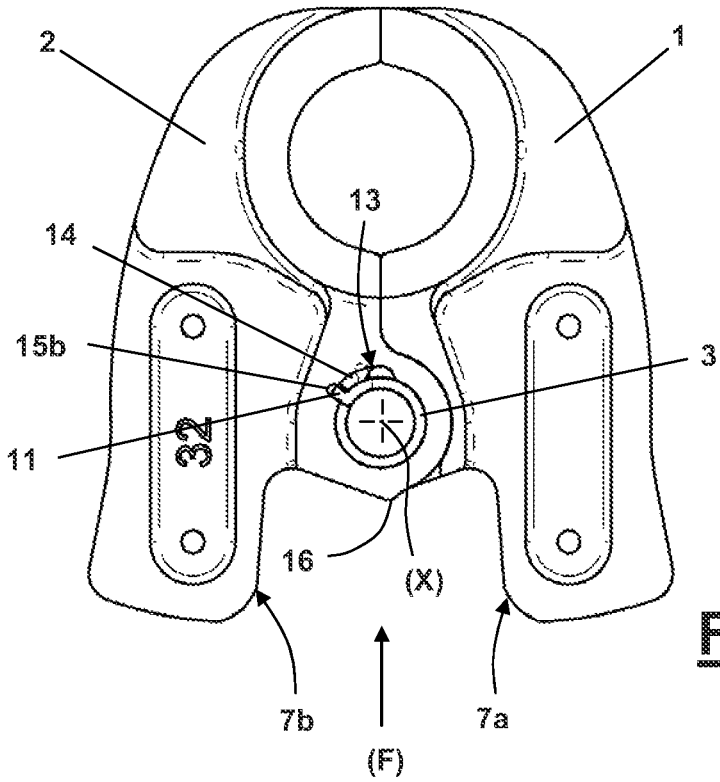

FIGS. 2*a, b* show a side view and a top view of the assembled and closed press jaw pair according to FIG. 1. In order to further elucidate the invention, this figure also shows the common axis (x), about which the press jaw levers 1, 2 are rotatably arranged. This figure also clearly shows the second assembly recess 13 of the second press jaw lever 2 with the inserting region 14 and the latching position 15*b*. FIG. 2*a* furthermore clearly shows that the torsion spring element 3 extends through the first bearing opening 5 of the first press jaw lever 1 and through only one bearing opening of the pair of bearing openings 9 of the second press jaw lever 2.

Figure 3A:
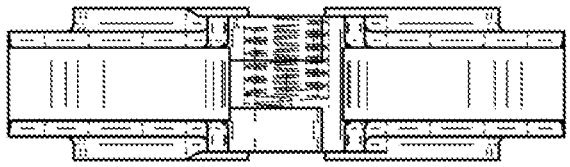
Figure 3B:
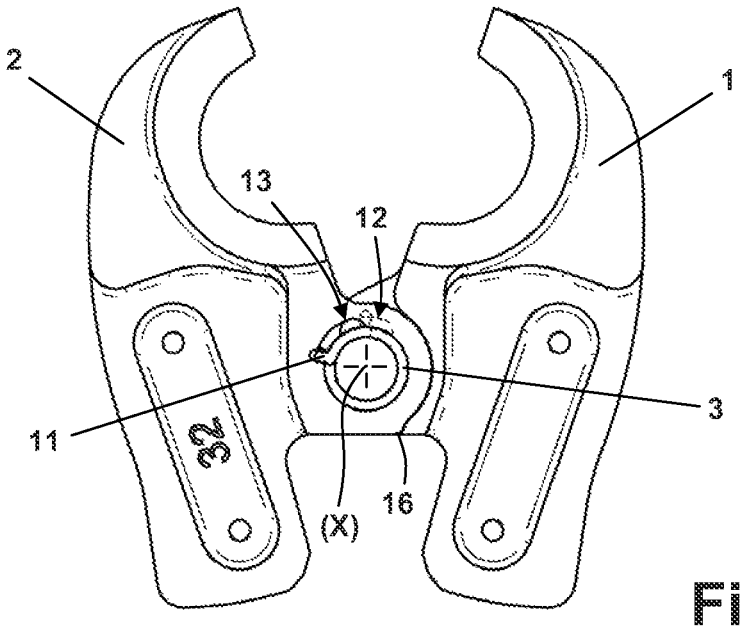

FIGS. 3*a, b* once again show a side view and a top view of the assembled and opened press jaw pair according to FIG. 1. In order to further elucidate the invention, the position of the first assembly opening 12 is also illustrated with broken lines in this figure. In this position, the torsion spring element 3 is maximally tensioned and consequently generates the highest restoring force. The pair of opening stops 16 is illustrated in its end position in this figure, i.e., the press jaw levers 1, 2 cannot be opened further and the torsion spring element 3 with its stop cams 10, 11 cannot be subjected to an excessive torque. It is assumed that the function of the pressing unit is known analogous to the cited state of the art. It should merely be noted that (not-shown) rolling bodies roll on the cam track shapes 7*a*, 7*b* and are pressed in the direction of the force (F) in such a way that the press jaw levers 1, 2 inevitably close (in this context, see FIG. 2*b*). In contrast to the initially cited state of the art, however, the spring element is used in such a way in this case that the press jaw levers 1, 2 can close automatically in the above-described fashion.

The assembly of the press jaw pair is very simple. It is merely required to assemble three components, namely the press jaw levers 1, 2 and the torsion spring element 3. For this purpose, the press jaw levers 1, 2 are assembled as shown in FIG. 2*a*, i.e., in the closed state. The torsion spring element 3 is then inserted into the bearing lug openings 5, 9, wherein this can be easily realized because the assembly recesses 12 and 13 make it possible to insert the protruding stop cams 10 and 11. The torsion spring element 3 is tensioned and thusly transferred into the assembly position by turning the stop cam in the counterclockwise direction (in this context, see FIG. 2*b*). The stop cam 10 of the torsion spring element 3 is initially engaged in the latching position 15*a* of the first assembly recess 12 while the stop cam 11 of the torsion spring element 3 is still situated in the inserting region 14 of the second assembly recess 13. The torsion spring element 3 is ultimately tensioned with its stop cam 11 until the latter engages in the latching position 15*b* of the second assembly recess 13.

A person skilled in the art will recognize that the principle with the torsion spring element that is simultaneously used for captively holding together and for supporting the press jaw levers in a spring-loaded fashion can also be readily applied to shapes of press jaw levers, in which each press jaw lever respectively has only one bearing lug or an identical number of bearing lugs. It is therefore also suitable for embodiments, in which press jaw levers with identical shapes are used for reasons of a rational parts manufacture.

LIST OF REFERENCE SYMBOLS

1 First press jaw lever
2 Second press jaw lever
3 The torsion spring element
4 First bearing lug
5 First bearing opening
6*a, b* Press jaw shape
7*a, b* Cam track shape
8 Pair of bearing lugs
9 Pair of bearing openings
10 First stop cam
11 Second stop cam
12 First assembly recess
13 Second assembly recess
14 Inserting region
15 Latching positions
16 Pair of opening stops
(X) Common axis
(F) Force direction

What is claimed is:

1. A press jaw pair for producing a press fit of fittings on an object, with a first and a second one-piece press jaw lever arranged such that the first and second press jaw levers are rotatable about a common axis, wherein at least one bearing lug with a bearing opening is integrally formed on each of the first and second press jaw levers, and wherein each of the at least one bearing lugs is arranged coaxially in a fitting state, wherein a torsion spring element with two stop cams is insertable into the bearing openings such that the first and second press jaw levers are supported about the common axis, are spring-loaded, and are mutually coupled together.

2. The press jaw pair according to claim 1, wherein a first bearing lug with a first bearing opening is integrally formed on the first press jaw lever and a pair of bearing lugs with a pair of bearing openings is integrally formed on the second press jaw lever, and wherein the first bearing lug engages into the pair of bearing lugs.

3. The press jaw pair according to claim 2, wherein the torsion spring element extends through the first bearing lug and one of the bearing lugs of the pair of bearing lugs.

4. The press jaw pair according to claim 2, wherein a first stop cam of the torsion spring element protrudes into a first assembly recess of the first press jaw lever and a second stop cam of the torsion spring element protrudes into a second assembly recess of one of the bearing lugs of the pair of bearing lugs of the second press jaw lever.

5. The press jaw pair according to claim 4, wherein the first and the second assembly recesses have latching positions for the first and second stop cams.

6. A press jaw pair for producing a press fit of fittings on an object, the press jaw pair comprising:

first and second one-piece press jaw lever arranged such that the first and second press jaw levers are rotatable about a common axis, at least one bearing lug with a bearing opening integrally formed on each of the first and second press jaw levers, wherein each of the at least one bearing lugs is arranged coaxially in a fitting state; and a torsion spring element with two stop cams inserted into the bearing openings such that the first and second press jaw levers are supported about the common axis, are spring-loaded, and are biased in a closed position.

* * * * *